US008006421B2

(12) United States Patent
Rykaczewski

(10) Patent No.: US 8,006,421 B2
(45) Date of Patent: Aug. 30, 2011

(54) STREET SIGN EXTRUSION

(75) Inventor: Michael R. Rykaczewski, Butler, PA (US)

(73) Assignee: Ibis Tek, LLC., Butler, PA (US)

( * ) Notice: Subject to any disclaimer, the term of this patent is extended or adjusted under 35 U.S.C. 154(b) by 0 days.

(21) Appl. No.: 12/462,016

(22) Filed: Jul. 28, 2009

(65) Prior Publication Data

US 2010/0088935 A1 Apr. 15, 2010

Related U.S. Application Data

(60) Provisional application No. 61/196,171, filed on Oct. 15, 2008.

(51) Int. Cl.
*G09F 7/00* (2006.01)

(52) U.S. Cl. ..... 40/612; 40/606.19

(58) Field of Classification Search ..... 40/612, 40/606.19, 605

See application file for complete search history.

(56) References Cited

U.S. PATENT DOCUMENTS

| | | | | | |
|---|---|---|---|---|---|
| 2,354,485 | A * | 7/1944 | Slaughter | 52/578 |
| 4,125,394 | A * | 11/1978 | Wilson | 71/9 |
| 4,604,820 | A * | 8/1986 | Edman | 40/605 |
| 4,698,928 | A * | 10/1987 | Soporowski | 40/651 |
| 4,762,904 | A * | 8/1988 | Nakama | 428/122 |
| 4,884,351 | A * | 12/1989 | Abramson | 40/611.05 |
| 5,060,126 | A * | 10/1991 | Tyler et al. | 362/277 |
| 5,257,472 | A * | 11/1993 | Harnois et al. | 40/611.05 |
| D381,041 | S * | 7/1997 | Lammers et al. | D19/32 |
| 7,670,527 | B2 * | 3/2010 | Malis | 264/261 |
| 2005/0066560 | A1 * | 3/2005 | Ternovits et al. | 40/606.19 |
| 2009/0217561 | A1 * | 9/2009 | Thompson | 40/606.12 |

* cited by examiner

*Primary Examiner* — Casandra Davis

(74) *Attorney, Agent, or Firm* — Karen Tang-Wai Sodini

(57) ABSTRACT

A street sign, made typically at least in part using an extrusion process, having a flat elongated section where the name of a street can be inscribed or otherwise indicated, and a length of thickened section along the top edge or the bottom edge of the flat elongated section, and including a channel or slot along at least a portion of the length of the thickened section.

4 Claims, 1 Drawing Sheet

STREET SIGN EXTRUSION

CROSS REFERENCE TO RELATED APPLICATION

Reference is made to and priority claimed from U.S. provisional application Ser. No. 61/196,171, filed Oct. 15, 2008.

TECHNICAL FIELD

The present invention relates in general to street signs and more particularly to street identification sign assemblies of the type mounted on vertical posts.

BACKGROUND OF THE INVENTION

The prior art provides various extruded, cast, or stamped forms for street signs of the type mounted on vertical posts. One such form is an extrusion having a thickened section along the entire length of the top and a thickened section along the entire length of the bottom of an otherwise thin flat section. The thickened sections provide some structural rigidity, especially useful in preventing vandalism.

Street signs generally show only the name of the street, and often because of local, state, or federal regulation, do not show any additional information. Communities often do wish to communicate additional information. For example, a school route could be indicated, or an historic trail, or a route to a hospital. Therefore additional information is sometimes provided by hanging a sign bearing the additional information from the street sign. For example, a second sign, bearing information other than the name of a street, is hung from a street sign using two chains attached to two holes in the street sign and two holes in the hung sign. Such sign assemblies are objectionable to some people on the grounds that the hung sign sways when there is wind or even just a breeze from a passing car.

What is needed is a way to provide additional information using a structure that is more an integral part of a street sign, without violating any local, state or federal regulations.

DISCLOSURE OF INVENTION

Accordingly, the invention provides a street sign that meets all federal, state and local regulations, but unlike the prior art, includes a slot/channel in a thickened section along at least a portion of the top or the bottom of the sign, into which additional (decorative or informative) signage may be inserted.

BRIEF DESCRIPTION OF THE DRAWINGS

The features and advantages of the invention will become apparent from a consideration of the subsequent detailed description presented in connection with accompanying drawings, in which.

DETAILED DESCRIPTION

Figure 1:
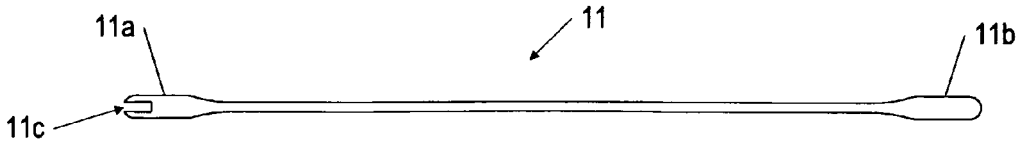
FIG. 1 is a perspective drawing showing a cutaway view of the street sign.
Figure 2:
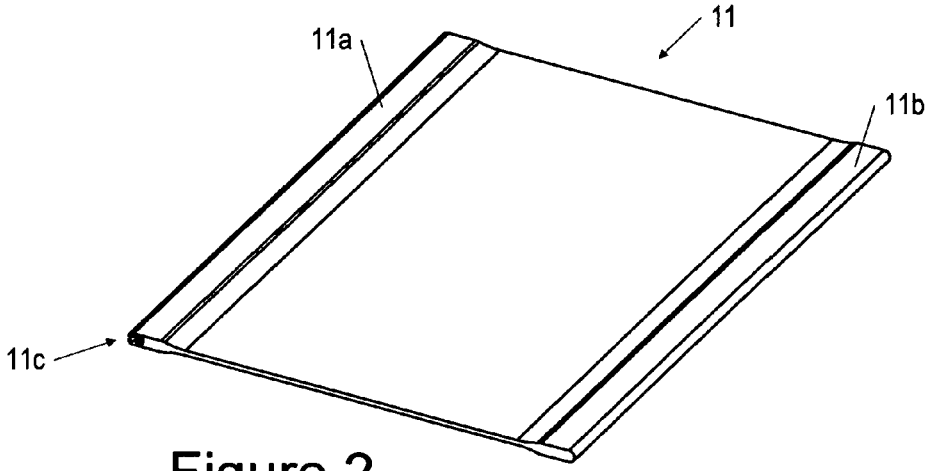
FIG. 2 is perspective drawing showing a top view of the street sign.
Figure 3:
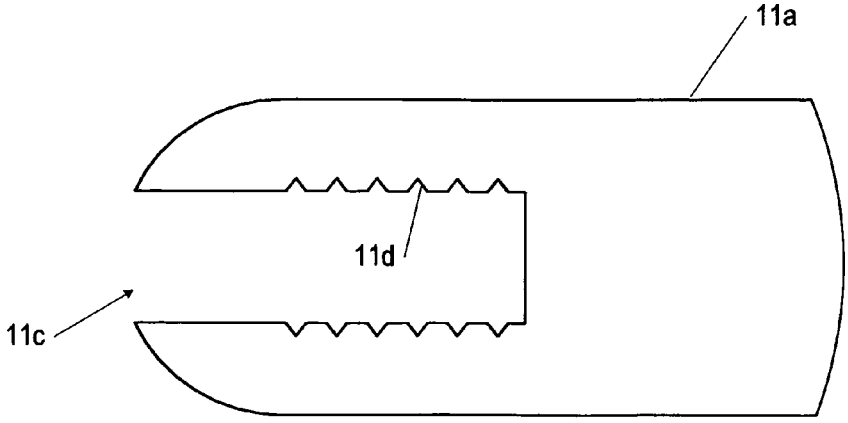
FIG. 3 is an enlarged perspective drawing of the channel of the street side.

Referring to FIGS. 1-3, in a typical embodiment of the invention, a street sign 11 is provided as an extrusion of a material, typically but limited to a metal such as aluminum, and includes a thickened section 11*a* along the top of the extrusion, and a similar thickened section 11*b* along the bottom of the extrusion, and a channel/slot 11*c* along the length of the top thickened section, of a thickness suitable for holding a secondary sign other than a street sign, having typically uniform thickness, used for decorative purposes or for conveying information other than the name of the street. When the secondary sign is inserted in the channel/slot provided according to the invention, the thickened section serves to provide additional strength to both the street sign and to the secondary sign. The secondary sign is thus, i.e. by virtue of the channel provided by the invention, made more integral with the street sign than a secondary sign hung from a street sign using two chains, according to the prior art.

In a typical embodiment, the secondary sign is secured in the channel/slot with an adhesive. Also in a typical embodiment, and as shown in FIG. 1, within the channel/slot are design features in the form of special grooves 11*d* formed along the length of the channel or slot, that provide small reservoirs for the adhesive to accumulate, and once signage is inserted into the slot and the adhesive dries, the groove feature provides a negative cavity to create much greater strength for the securing of secondary signage.

The invention also encompasses embodiments in which the channel/slot 11*c* is provided only over a portion of the length of a thickened section as opposed to along the entire length, but in such embodiments the channel/slot must be provided by other than an extrusion process although an extrusion process may be used to provide the base sign, i.e. the sign less the channel/slot.

The invention should be understood to encompass a slot or channel along the top of the top thickened section or instead (or in addition) along the bottom of the bottom thickened section. In case of the latter, the secondary sign is disposed below the street sign to which it is made an integral member by virtue of the channel or slot provided by the invention.

It is to be understood that the above-described arrangements are only illustrative of the application of the principles of the present invention. Numerous modifications and alternative arrangements may be devised by those skilled in the art without departing from the scope of the present invention, and the appended claims are intended to cover such modifications and arrangements.

What is claimed is:

1. A street name sign, comprising:

an extrusion having a substantially flat elongated section for inscribing or otherwise indicating the name of a street, and having a top edge and a bottom edge above and below where the name of the street is to be provided, respectively, and a length of thickened section along the top edge and the bottom edge;

wherein channel or slot is provided along the length of at least one of the thickened section, the channel or slot comprising two parallel planar side walls in spaced apart relation and a back wall connecting the two side walls, and wherein a plurality of spaced apart grooves are provided along the length of each side wall of the channel or each groove being provided as a track or furrow in a respective one of the side walls, whereby the channel or slot is unobstructed by the grooves and enlarged in volume.

2. A street name sign as in claim 1, wherein the channel or slot has an open end and a closed end, and wherein the plurality of grooves are formed near the closed end of the channel so that the channel is free of grooves near the open end, whereby adhesive captured by the plurality of grooves is less likely to flow to the open end and out of the channel.

3. A street name sign as in claim 1, further comprising a quantity of adhesive in the plurality of the grooves.

4. A street name sign as in claim 3, further comprising a secondary sign having an edge disposed within the channel or slot, and held in place by the adhesive.

* * * * *

UNITED STATES PATENT AND TRADEMARK OFFICE

CERTIFICATE OF CORRECTION

PATENT NO. : 8,006,421 B2
APPLICATION NO. : 12/462016
DATED : August 30, 2011
INVENTOR(S) : Michael R. Rykaczewski It is certified that error appears in the above-identified patent and that said Letters Patent is hereby corrected as shown below:

column 2, line 47, “wherein channel or slot” should read --wherein the channel or slot--;
column 2, line 48, “thickened section” should read --thickened sections--;
column 2, lines 51-52, “the channel or each groove” should read --the channel or slot, each groove--.

Signed and Sealed this
Fourth Day of October, 2011

David J. Kappos

David J. Kappos
*Director of the United States Patent and Trademark Office*